US005105996A

United States Patent [19]

Freeland et al.

[11] Patent Number: 5,105,996

[45] Date of Patent: Apr. 21, 1992

[54] BRACE FOR PROPANE GAS CYLINDER LIQUID LINE

[75] Inventors: Thomas B. Freeland, Dallas, Tex.; Jefferey S. Hope, Nappanaee, Ind.; Kenneth W. Childs, Buena Park, Calif.

[73] Assignee: Manchester Tank and Equipment Company, Buena Park, Calif.

[21] Appl. No.: 672,544

[22] Filed: Mar. 21, 1991

[51] Int. Cl.[5] ..... B67D 5/60

[52] U.S. Cl. ..... 222/464; 220/584; 222/3

[58] Field of Search ..... 222/3, 464, 211, 382; 220/584, 581, DIG. 25

[56] References Cited

U.S. PATENT DOCUMENTS 2,036,698 4/1936 Hill, Jr. ..... 222/464
4,304,038 12/1981 Yabu et al. ..... 220/581 X
4,445,630 5/1984 Gartman et al. ..... 222/464
4,828,131 5/1989 Strubel ..... 222/464
4,946,056 8/1990 Stannard ..... 220/584

*Primary Examiner*—Michael S. Huppert
*Assistant Examiner*—Gregory L. Huson
*Attorney, Agent, or Firm*—Roberts and Quiogue

[57] ABSTRACT

An improved aluminum propane gas cylinder with a braced liquid line or pipe. The brace is welded to a joggle formed in the rim of the cylinder top head section, and includes a pair of tines which are crimped around the liquid pipe to secure it against vibration. Securing the brace to the top head joggle permits assembly of the liquid pipe to the brace before joining the top and bottom head sections, and complies with regulations against welding to the straight surface of the cylinder. With the liquid line brace in this manner, the susceptability of the liquid line to fatigue cracking is substantially reduced.

8 Claims, 1 Drawing Sheet

FIG. 1
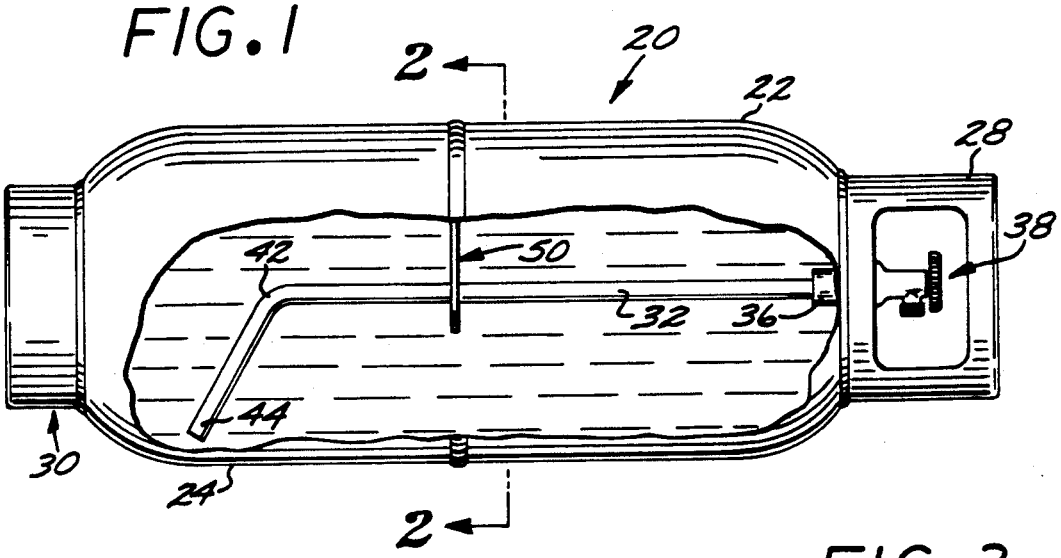
FIG. 2
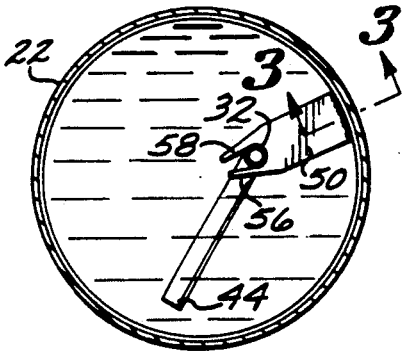
FIG. 3
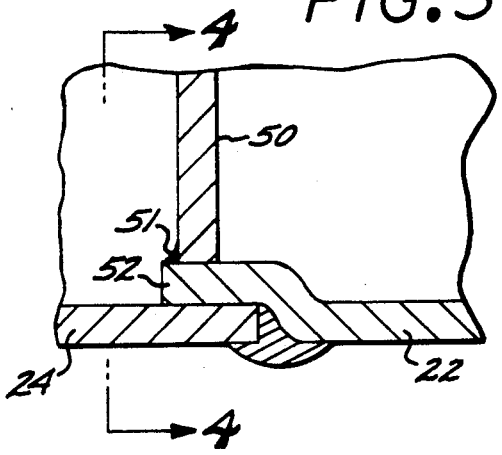
FIG. 4
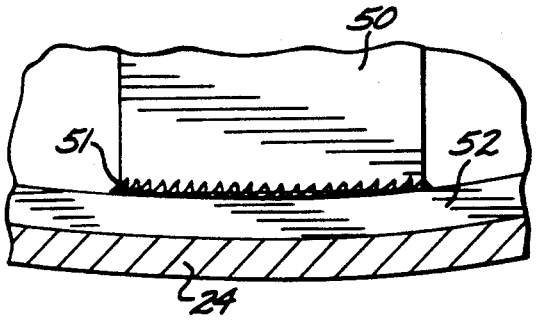
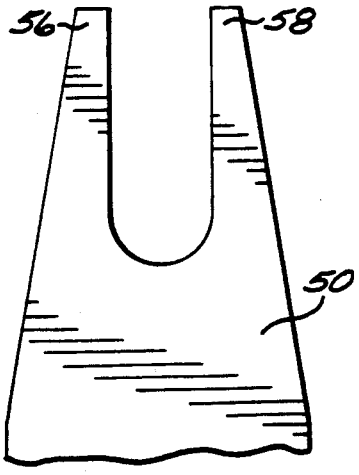
FIG. 5

BRACE FOR PROPANE GAS CYLINDER LIQUID LINE

BACKGROUND OF THE INVENTION

The present invention relates to pressurized fuel cylinder tanks of the type used for propane gas fueled vehicles such as fork lift trucks, and more particularly to a means for stabilizing the steel liquid line.

Fork lift trucks are typically powered by engines running on propane gas supplied from propane gas cylinders. Such cylinders are made from lightweight metals such as aluminum. Because the cylinders are typically laid on their side when positioned on the truck in use, a steel liquid pipe runs from the service valve coupling at the top of the cylinder into the interior of the cylinder, and has a bend formed in it to position the open end of the pipe adjacent the side of the cylinder at its lowermost point. This allows the fuel to be released via the pipe out the service valve to essentially empty the cylinder.

A significant problem exists in such conventional aluminum gas cylinders with steel liquid pipes, in that, due to the long lever arm presented by the pipe, vibrations of the pipe result in significant moments on the connection of the pipe to the service valve coupling. As a result, the liquid pipe has suffered a relatively high incidence of developing fatigue cracks at the point where it is internally threaded into the aluminum service valve coupling.

A solution to the problem of stabilizing the steel liquid pipe in an aluminum cylinder is therefore needed. However, the Department of Transportation requirements as to the construction of cylinders must also be complied with, including requirements that permit no welding to the straight sides of a cylinder wall.

It is therefore an object of this invention to provide an aluminum gas cylinder with means for stabilizing the steel liquid pipe to inhibit vibrations and the moment caused by the long lever arm of the pipe.

SUMMARY OF THE INVENTION

An aluminum propane gas cylinder is disclosed with a means for supporting the steel liquid pipe against vibration. In accordance with the invention, the supporting means is characterized in that the top head section of the cylinder includes a joggle lip which mates with a substantially straight rim lip of the cylinder bottom head section, and by an aluminum brace member welded to the joggle. The brace member includes a pair of spaced tines which are spaced apart enough to allow the liquid pipe to be fitted therebetween. The liquid pipe can be secured to the brace prior to assembly of the top and bottom head sections by fitting the pipe between the tines and then crimping the two tines together so as to clamp the pipe in the brace. Once the pipe has been secured to the brace, the top and bottom head sections can be welded together to form the cylinder.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a frontal, partially broken-away view of an aluminum gas cylinder embodying a brace in accordance with the invention.

FIG. 2 is a cross-sectional view of the cylinder of FIG. 1, taken along line 2—2 of FIG. 1, showing a top view of the brace securing the steel liquid pipe.

FIG. 3 is a cross-sectional view taken along line 3—3 of FIG. 2, showing the weld joints securing the brace to the top head joggle.

FIG. 4 is a partial cross-sectional view taken along line 4—4 of FIG. 3, showing the brace and weld joint in further detail.

FIG. 5 is a partially broken-away view of the brace, showing the brace tines in further detail.

DETAILED DESCRIPTION OF THE PREFERRED EMBODIMENT

An embodiment of an aluminum propane gas cylinder 20 for use on a fork lift truck and embodying the present invention is illustrated in FIGS. 1–5. The cylinder 20 comprises a top head section 22 and a bottom head section 24, which are secured together by a circumferential weld joint 26 to form a pressure vessel for containing propane gas. Both the top head and bottom head sections are fabricated from aluminum to minimize the weight of the cylinder and resist corrosion. In this embodiment, the top and bottom head sections 22 and 24 are made of 5154 aluminum alloy.

In the conventional manner, an aluminum guard or collar 28 is welded to the top head 22, and an aluminum footring 30 is welded to the bottom of the bottom head section 24.

The cylinder 20 further comprises a steel liquid pipe 32 contained within the cylinder 20. In this embodiment, the pipe 32 is a ⅜ inch NPS pipe. One end 33 of the pipe 32 is threaded into a ⅜ NPT aluminum coupler 36 which in turn connects to a service valve 38. The valve 38 is used to connect to the engine to provide the fuel for engine operation. The pipe 32 has a bend 42 formed therein to bring the pipe end 44 adjacent the side of the bottom head 24. In operation, the cylinder 20 is laid horizontally on its side as shown in FIG. 1, and oriented as shown in FIG. 1 so that the end 44 is at or near the lowermost point in the cylinder 20, to permit as much as possible of the fuel in the cylinder to be removed via the pipe 32.

The cylinder 20 further includes additional fittings, such as a fill valve, a fill couple, a float valve to indicate the fuel level and a pressure relief valve (these additional fittings are not shown in FIG. 1) in the conventional manner.

To relieve the strain on the liquid pipe 32 due to its long lever arm and the vibration experienced during operation of the fork lift truck, a brace 50 is included to secure the pipe in accordance with the present invention. The brace 50 is made of ⅛ inch thick aluminum, in this embodiment 6061-T6 aluminum alloy. Use of this material permits welding the brace 50 to the joggle 52 of the top head section 22. The brace 50 further defines two protruding tines 56 and 58, which are spaced apart by a sufficient distance (prior to assembly with the pipe 32) to just allow the pipe 32 to be fitted between the tines. It is desirable to provide a slot dimension between the tines which is only slightly larger than the outer dimension of the pipe 32, so that the pipe fits tightly between the tines. This facilitates the clamping of the pipe tightly between the tines, so that the tine compression or crimping is not required to do all the work of securing the pipe in place.

The conventional aluminum cylinder for this application typically employs a bottom head section with a joggle at the top lip thereof to mate with the downwardly extending rim of the top head section. The top head is then welded to the bottom head at the meeting of the joggle of the bottom head with the rim of the top head. There is a U.S. Department of Transportation requirement which prohibits welding directly to the straight side of a cylinder, in order to avoid reducing the integrity of the cylinder.

In accordance with the invention, the forgoing arrangement is reversed, in that the joggle 52 is formed in the top head 22 instead of the bottom head 24, and the bottom head 24 is formed with a straight rim 54. This arrangement permits the brace 50 to be welded to the joggle 52 of the top head 22 prior to the mating of the top and bottom head sections 22 and 24, in the manner best illustrated in FIGS. 3 and 4. The pipe 32 can then be fitted between the tines 56 and 58 of the brace 50 prior to assembling the top and bottom heads 22 and 24, and the tines squeezed together to secure the pipe 32 in place, as best shown in FIG. 2. It will be appreciated that the tines 56 and 58 permit mechanical engagement with the steel pipe 32 by crimping the tines together into contact with the pipe. Because the brace is aluminum, and the pipe is steel, welding the brace to the pipe would be difficult due to the dissimilar materials.

If the conventional joggle configuration were used, the brace could only be welded to the bottom head, rendering it difficult or impossible to fit the pipe into the brace and secure it in place, since this operation would have to be done while fitting the top and bottom head sections together. In contrast, with the joggle being formed on the top head, the brace 50 can be welded to the joggle 52, and the pipe 32 can be assembled to the coupler 36 and secured to the brace 50 before the top head is mated to the bottom head. Once the top head 22 is mated to the bottom head 24, these sections can be welded together with a weld joint 26 in the conventional manner.

In the preferred embodiment illustrated in FIGS. 1–5, the brace 50 is welded to the joggle 52 by gas tungsten arc welding. A welding filler wire found particularly well suited to the purpose for welding the 6061-T6 aluminum brace 50 to the joggle of 5154 aluminum is 4043 aluminum alloy filler wire. This particular filler wire is compatible with the two aluminum alloys, the 6061-T6 and the 5154, yet is a ductile material which provides a strong bond between the brace and the joggle. It is important that good welding techniques be employed to weld the brace to the joggle, such as welding to the ends of the brace and having an ample supply of the filler wire, so that the weld joint is not starved for filler during the welding process, and allowing the weld to spill over slightly at the brace ends. Such good welding techniques should be employed to prevent cracking of the weld due the vibration experienced during operation of the fork lift truck.

Tests of an aluminum cylinder incorporating the brace of the present invention demonstrate that the use of the brace to support the liquid pipe significantly extends the fatigue life of the pipe as it exits from the aluminum coupling 36.

Advantages of the brace described above include the securing of the liquid pipe against vibration, thereby reducing the stress on the pipe and reducing stress failure rates, while fulfilling the requirement that no welding can be done to the straight sides of the cylinder. Further, the brace secures the pipe in a rugged and inexpensive manner even though the pipe and the brace are of dissimilar materials which cannot readily be welded together. While the brace disclosed herein is clamped onto the pipe by crimping the tines, and such method is particularly advantageous because of its simplicity, low cost and ruggedness, other mechanical means of connecting the brace to the pipe could alternatively be employed, such as inserting the pipe through a hole in the brace element.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. In an aluminum cylinder for propane gas or the like used to provide fuel for vehicles such as fork lift trucks, including an aluminum top head section and an aluminum bottom head section welded together, and a steel liquid pipe extending from a service valve coupler in the top head section, a means for supporting said steel liquid pipe against vibration, said means characterized in that said top head section includes a joggle lip which mates with a substantially straight rim lip of said bottom head section, an aluminum brace member welded to said joggle of said top head section and comprising first and second tines separated by a distance sufficient to receive said liquid pipe therebetween, said tines being thereafter crimped toward each other to secure said liquid pipe therebetween prior to the welding together of said top and bottom head sections.

2. The bracing means of claim 1 wherein said aluminum brace element has a thickness of about ⅛ inches, thereby facilitating the crimping of said tines.

3. The bracing means of claim 1 wherein said top head section is made of 5154 aluminum alloy, said brace element is made of 6061-T6 aluminum alloy, and said brace element is welded to said joggle using filler wire of 4043 aluminum alloy.

4. An aluminum fork lift truck cylinder for propane gas, comprising:

an aluminum top head section, comprising a joggle lip formed therein;

an aluminum bottom head section, comprising a substantially straight rim, said rim and said joggle lip sized to mate together and permit welding of said top and bottom head sections together during the construction of said cylinder;

a steel liquid pipe having first and second ends, said first end being secured to a service valve by a coupler and an open second end being disposed after assembly of said cylinder adjacent a side surface of said cylinder, so that when the cylinder is disposed on its side and positioned so that said second end of said pipe is adjacent the lowermost side of the cylinder, fuel may be withdrawn from said cylinder; and means for supporting said steel liquid pipe against vibrations, said means comprising an aluminum brace member welded to said joggle lip of said top head section and means for mechanically securing said steel pipe to said brace member, said supporting means further characterized in that said steel pipe may be secured to said coupler and by said supporting means prior to fitting said top head and bottom head sections together and welding said sections together, thereby easing the assembly of the cylinder.

5. The cylinder of claim 4 wherein said brace member comprises first and second tines separated by a distance about equal to the outer dimension of said steel pipe, and said securing means comprises said tines being placed in a crimped position after said pipe has been fitted between said tines.

6. The cylinder of claim 5 wherein said brace member is fabricated of an aluminum alloy approximately $\frac{1}{8}$ inch thick.

7. The cylinder of claim 5 wherein said top head section is made of 5154 aluminum alloy, said brace member is made of 6061-T6 aluminum alloy, and said brace member is welded to said joggle lip by a gas tungsten arc welding process using filler wire of 4043 aluminum alloy.

8. The cylinder of claim 4 further characterized in that said steel pipe is threaded into said service valve coupler.

* * * * *